US006035478A

United States Patent [19]

Miller et al.

[11] Patent Number: 6,035,478

[45] Date of Patent: Mar. 14, 2000

[54] ROTARY BROOM MOUNTING

[75] Inventors: Darin T. Miller, Gwinner, N. Dak.; Michael L. Vought, Grove City, Minn.; Philip D. Bogner, Lisbon, N. Dak.

[73] Assignee: Clark Equipment Company, Woodcliff Lake, N.J.

[21] Appl. No.: 09/095,387

[22] Filed: Jun. 10, 1998

[51] Int. Cl.[7] ..... E01H 1/05

[52] U.S. Cl. ..... 15/82; 37/233; 56/15.8; 56/15.9; 172/247; 172/253; 172/519

[58] Field of Search ..... 15/82–87, 340.3, 15/340.4; 37/233, 257; 56/15.8, 15.9; 172/108, 518, 519, 247, 253, 532

[56] References Cited

U.S. PATENT DOCUMENTS

| | | | |
|---|---|---|---|
| 959,380 | 5/1910 | Otis | 15/84 |
| 1,452,307 | 4/1923 | Martin | 15/87 |
| 2,229,229 | 1/1941 | Wagner | 15/82 |
| 2,601,695 | 7/1952 | Grace | 15/328 |
| 2,631,314 | 3/1953 | Fitzpatrick | 15/83 |
| 2,895,151 | 7/1959 | Link, Jr. | 15/87 |
| 3,189,932 | 6/1965 | Daneman | 15/340.3 |
| 3,197,798 | 8/1965 | Brown et al. | 15/320 |
| 3,284,831 | 11/1966 | Larsen | 15/82 |
| 3,292,195 | 12/1966 | Schmidt et al. | 15/87 |
| 3,444,583 | 5/1969 | Laurel | 15/340.3 |
| 3,825,968 | 7/1974 | Larsen | 15/87 |
| 4,525,888 | 7/1985 | Bargiel et al. | 15/83 |
| 4,811,442 | 3/1989 | Barker | 15/82 |
| 4,895,476 | 1/1990 | Vangaever | 404/108 |
| 4,926,517 | 5/1990 | Smith | 15/82 |
| 5,240,085 | 8/1993 | Klossner et al. | 180/53.1 |
| 5,279,014 | 1/1994 | Wise et al. | 15/82 |

FOREIGN PATENT DOCUMENTS

| | | | |
|---|---|---|---|
| 152868 | 3/1938 | Austria | 37/257 |

*Primary Examiner*—Mark Spisich
*Attorney, Agent, or Firm*—Westman, Champlin & Kelly, P.A.

[57] ABSTRACT

A mounting for a rotary broom on a skid steer loader has a bracket that is attached to a frame plate that mounts on the front attachment plate of the skid steer loader. The front attachment plate can be tilted about a horizontal axis through the use of a tilt cylinder on the skid steer loader. The bracket is in turn pivotally mounted about a horizontal axis adjacent the top of the frame plate, and the weight of the broom, and the mounting bracket tending to pivot the lower portion of the bracket toward the frame plate is counterbalanced by a pair of compression springs on the lower part of the bracket, which react force or movement loads back to the frame plate. In this way, the counterbalancing springs are kept low, out of sight, and out of the way.

8 Claims, 5 Drawing Sheets

ROTARY BROOM MOUNTING

BACKGROUND OF THE INVENTION

The present invention relates to a powered rotary broom that is mounted onto a mobile vehicle, for example, a skid steer loader, and which has a frame supporting the broom about a horizontal pivot axis with springs positioned to counterbalance the broom weight about the pivot axis. The counterbalancing springs are mounted so they do not interfere with sight lines of the operator or with the entrance opening for the vehicle cab.

In the prior art, various rotary brooms mounted on vehicles have been advanced. These brooms are generally housed within an enclosure that has end plates and a top wall. The broom is rotatably mounted on the end plates and is capable of being pivoted about an upright axis to change the broom angle. The broom housings have also been mounted about a horizontal pivot axis to a mounting frame. Counterbalancing the relatively heavy broom assembly about the horizontal pivot has been done with tension springs at the top of the broom housing extending over to a support on the frame that extends upwardly, where it interferes with sight lines of an operator of a skid steer loader for example, as well as being in the way of an operator getting into or out of the skid steer loader cab.

Gage wheels have been used for height adjustment but such wheels are prone to damage and require the operator to leave the loader to make adjustments for bristle wear or to change the bristle down pressure for proper sweeping.

The use of brooms mounted on skid steer loaders which have quick attachment plates is wide spread, but the present device aids in controlling height and down pressure and obstruction of the operator's view.

SUMMARY OF THE INVENTION

The present invention relates to a spring assembly for counterbalancing the weight of a rotary broom relative to a frame one which it is pivotally mounted. The broom preferably is mounted onto the front of a prime mover, such as a skid steer loader. The counterbalance is provided by compression springs on the lower portion of the mounting frame, so that when the broom tends to pivot about a horizontal mounting axis downwardly, the springs are compressed, and the downward load of the broom, the broom housing and the mounting brackets tending to pivot downwardly about the mounting axis is reacted by the springs.

The broom housing mounting to the broom frame, which as shown is attached to a skid steer loader mounting or attachment plate, also provides pivoting of the broom housing about a vertical axis to change the broom angle.

The mounting or attachment plate on skid steer loaders can also be tilted with a tilt cylinder to permit adjusting the broom bristle downward load to suit the application from the operator's seat without leaving the loader cab. The attachment plate can be rolled forwardly to increase the spring compression of the counterbalance springs that are used and increase the bristle load for applications such as sweeping heavy, wet snow. A rolled back position of the attachment plate will decrease the bristle load and extend bristle life for dust and light rock sweeping.

The profile of the mounting structure is kept low, and out of the way of the passage for operators to and from the cab of a skid steer loader.

DETAILED DESCRIPTION OF THE PREFERRED EMBODIMENTS

Figure 1:
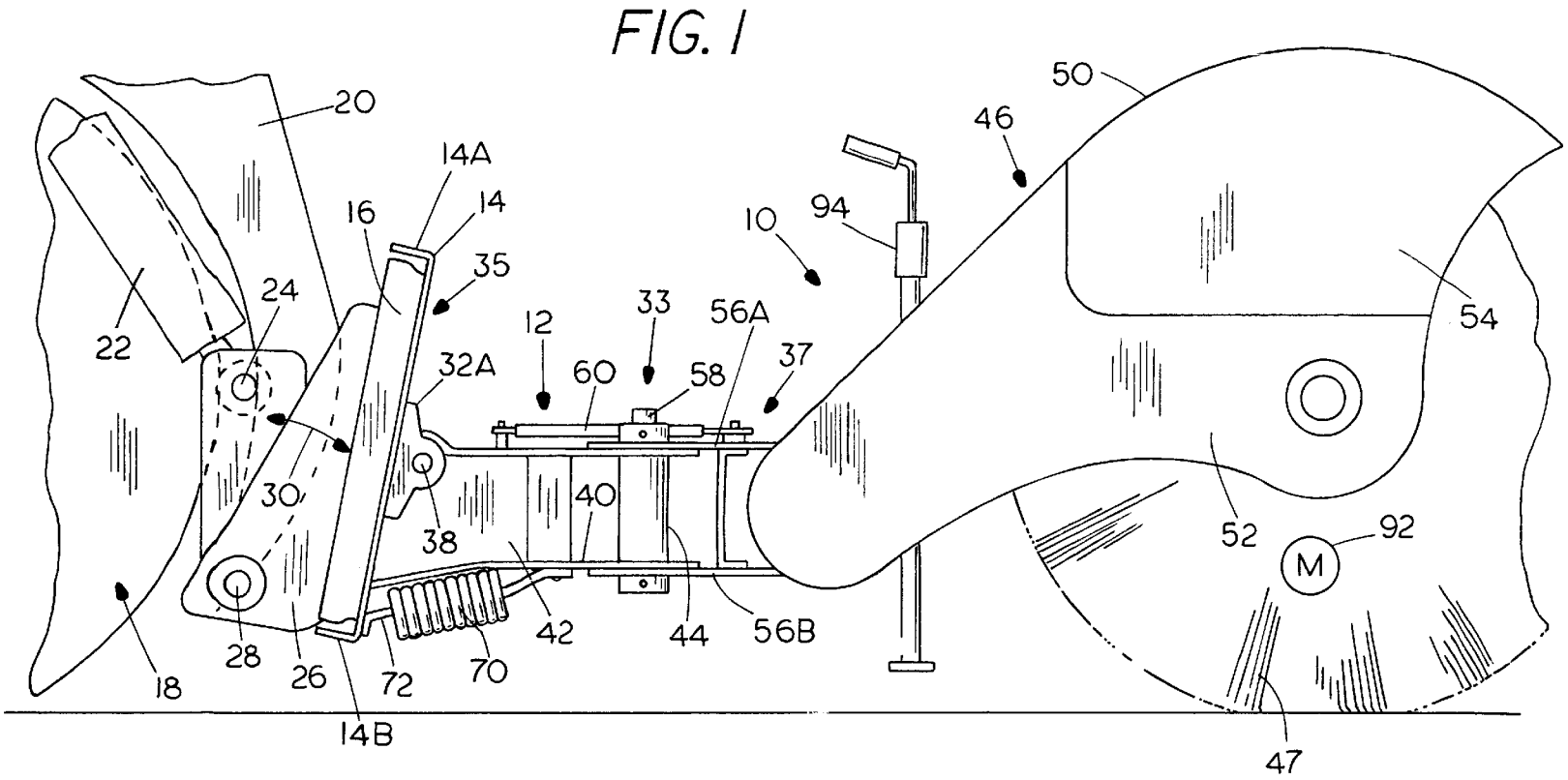
FIG. 1 is a side elevational view of a broom mounting made according to the present invention shown installed on a skid steer loader.

A powered rotary broom assembly indicated generally at 10 is adapted to be mounted with a mounting frame assembly 12 including a base frame plate 14 that includes top and bottom flanges 14A and 14B that will mount over and be locked onto a quick attachment plate assembly 16 of a skid steer loader shown schematically at 18. The flanges 14A and 14B form means for attaching the base frame plate to the skid steer loader attachment plate. The loader 18 has lift arms 20, which are raisable and lowerable with hydraulic actuators (not shown) in a normal manner for a skid steer loader. A tilt cylinder or actuator 22 is coupled to a cross member on the lift arms and its rod end is coupled to the quick attachment plate 16 through a pivot bolt 24. The quick attachment plate 16 has side plates 26 that are pivotally mounted to the lower ends of the loader arms 20 on pins 28. By extending and retracting the tilt cylinder 22, the angle of the quick attachment plate 16 and the thus the frame plate 14 and bracket assembly 12 can be changed relative to a horizontal plane, as indicated by double arrow 30. The loader arms 20 can be raised and lowered as well.

Figure 2:
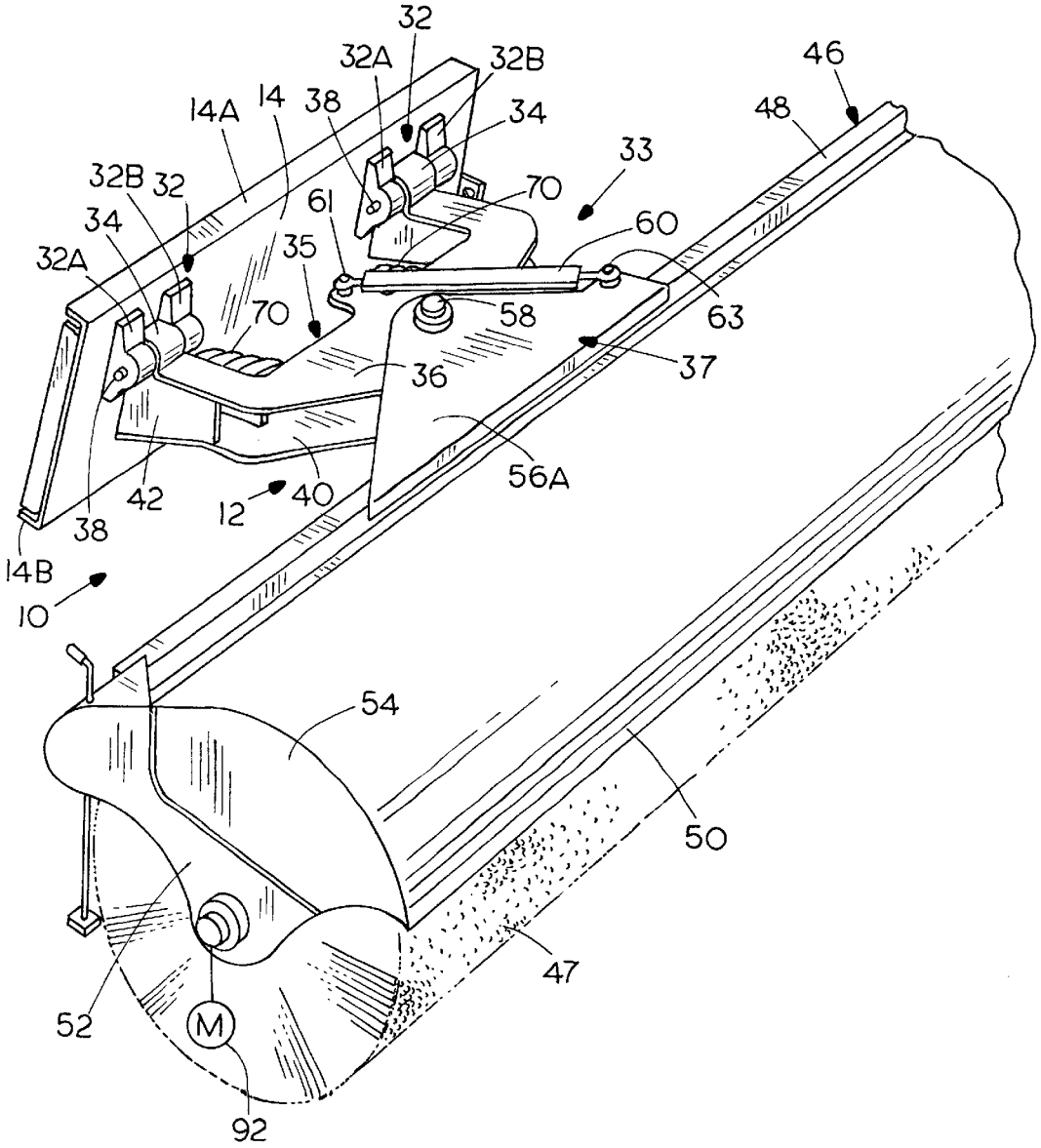
FIG. 2 is a top perspective view of the device of FIG. 1.

The frame plate 14 has a pair of pivot block assemblies 32, on the front side thereof (see FIGS. 1 and 2). Each of the pivot block assemblies 32 comprises two blocks 32A and 32B, that are spaced apart, as can be seen, and end hubs 34 of a top broom frame plate member 36 are each pivotally mounted with a pin 38 between the opposite pairs of the pivot blocks 32. The broom frame plate member 36 is part of a broom mounting frame or bracket assembly 33 that has a base section 35 and an outer section 37. The outer section 37 is pivotally mounted to the base section 35 about a vertical pivot, (pin 58) to permit changing the angle of the broom.

The frame plate member 36 overlies a lower frame plate member 40 that is rigidly mounted relative to the upper frame member 36 with suitable vertically extending plates 42 near the frame plate 14, and a pivot sleeve 44 extends between the frame plate members 36 and 40 at the forward end of the base section 35.

A broom housing 46 has a main frame cross member 48 (FIG. 2) at the back side of a top shroud 50. End plates 52 mount on the cross member 48 and fit within depending side portions 54 of the broom shroud.

The main cross member 48 has a pair of plates on the top and bottom indicated at 56A and 56B, that overlap the outer end portions of the frame members 36 and 40. A pivot pin 58 passes through the plates 56A and 56B, the sleeve 44, and the frame members 36 and 40. This permits the cross member 48 and the entire broom housing 46 and the rotatable broom 47 mounted thereon to pivot about an upright axis. The broom is rotatably mounted on the end plates 52 on suitable bearing as is well known. A hydraulic actuator shown schematically at 60 in FIG. 2 has its base end mounted on the frame member 36 with a pin 61 and the rod end connected between the top plate 56A and bottom plate 56B of the broom housing with a pin 63. The actuator 60 is used for changing the angle of the broom about an upright axis.

Figure 3:
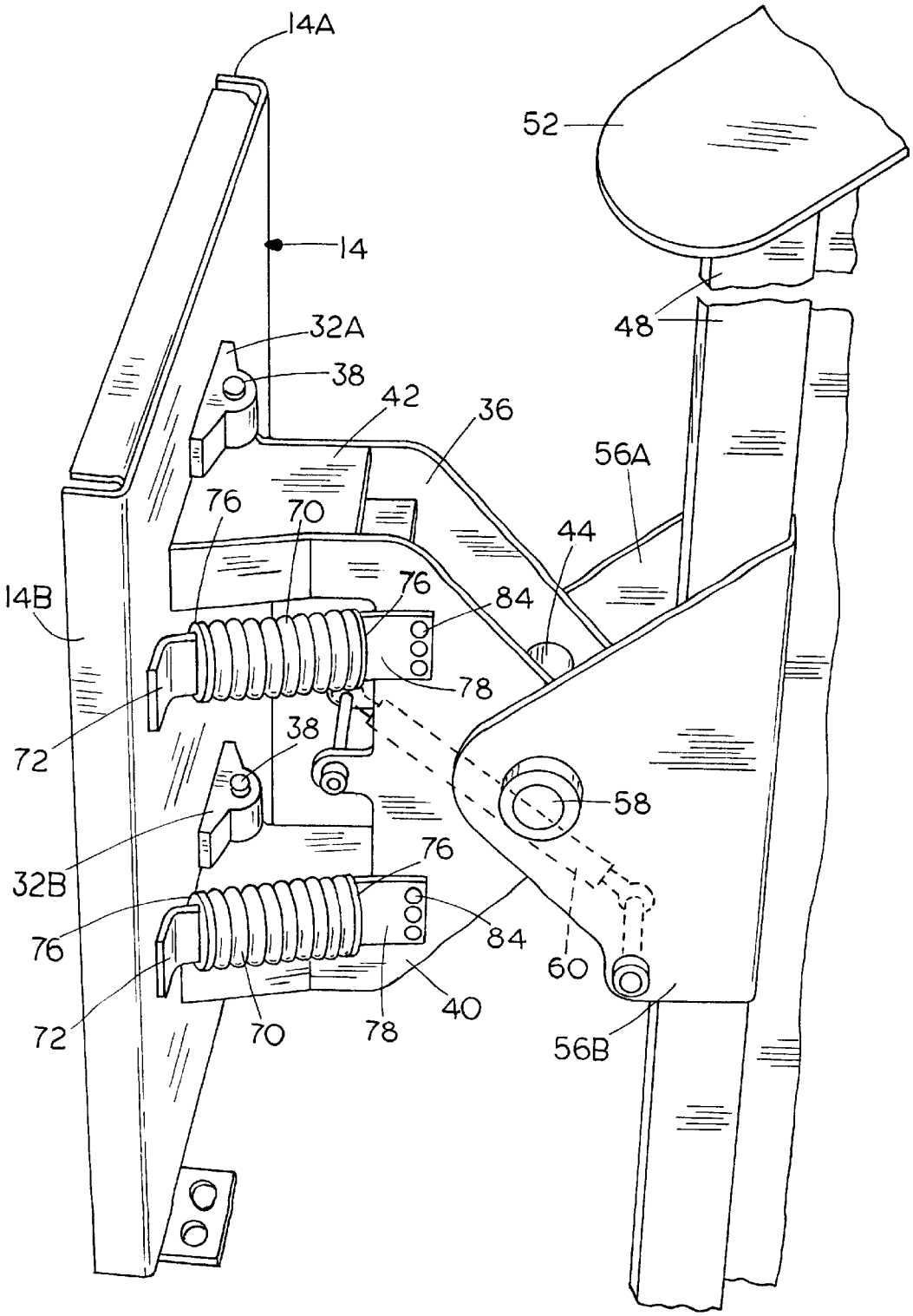
FIG. 3 is a bottom perspective view of the device of FIG. 1.
Figure 4:
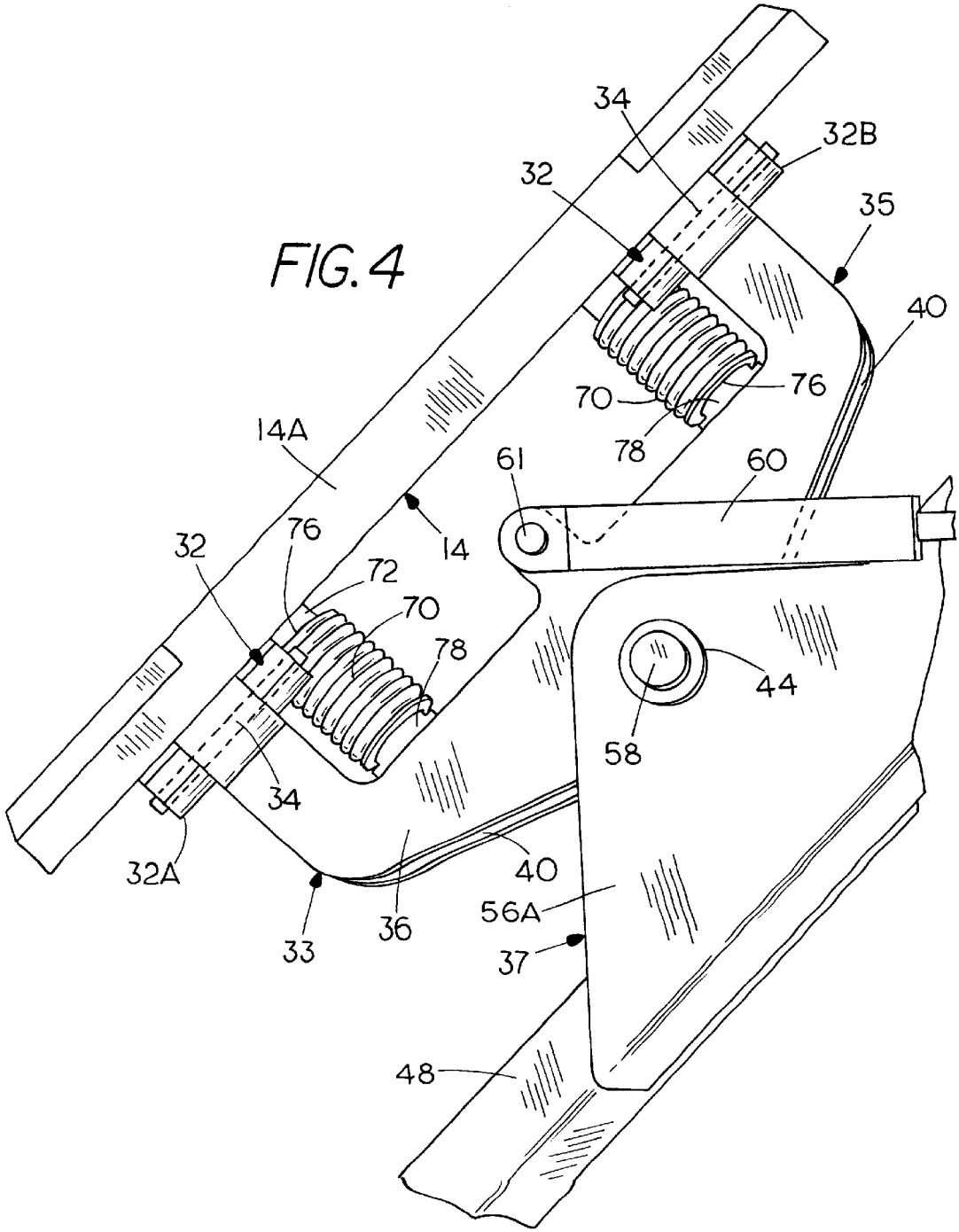
FIG. 4 is a top view of the loader mounting plate and the broom mounting assembly of the present invention.

The base frame section 35 includes the upper and lower frame members 36 and 40, and the vertical plates 42, as well as other desired reinforcements. The frame section 35 and the outer frame section 37, which carries the broom housing 46 through the upper and lower plates 56A and 56B is connected to the base section by pin 58 passing through sleeve 44. The broom mounting frame assembly 33 and the broom housing 46 are pivoted as a unit with the pins 38 to the plate 14 and the lower plate 40 will be urged toward plate 14 under gravity. This load from pivoting clockwise in FIG. 1 is resisted by a pair of heavy compression springs shown at 70, one on each side of the frame plate 14. The compression springs 70 carry at least a portion of the weight of the broom housing. The bottom view of FIG. 3 also shows the springs 70.

Figure 5:
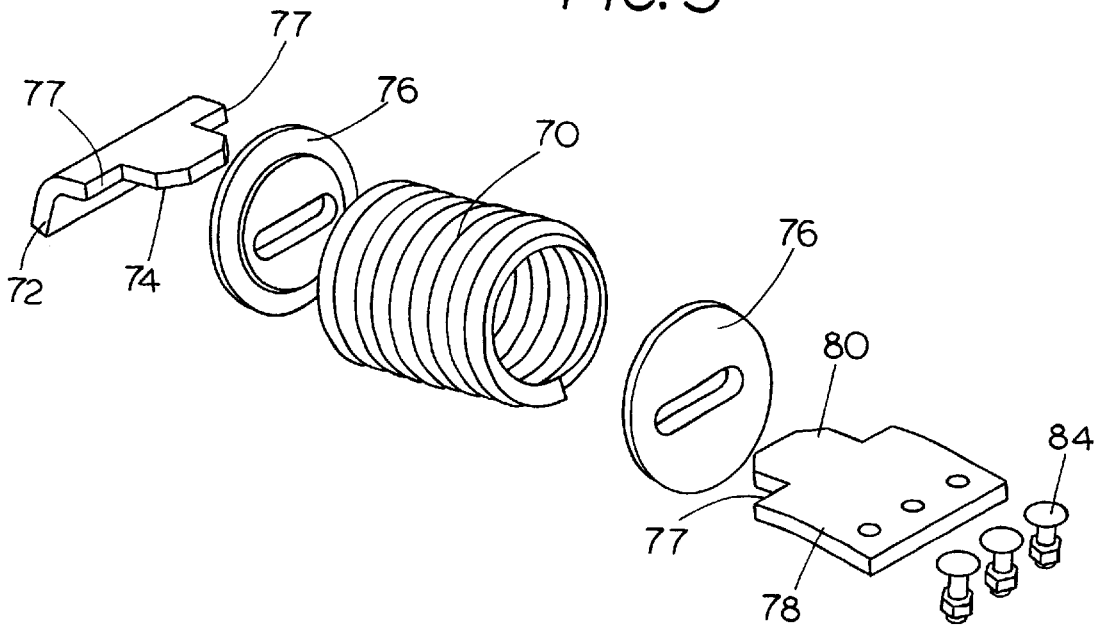
FIG. 5 is an exploded view of one of the compression springs and the mounting members for counterbalancing the broom.

The compression springs 70 are held in place using angled brackets 72 on each side of the frame plate 14, which brackets 72 are welded to the frame plate 14 and each bracket 72 has an outwardly extending tongue (see FIG. 5) 74 that slides into a washer 76. The washer 76 abuts against shoulder surfaces 78 on the bracket 72, and also forms a seat for the end of the compression spring 70 on each side of the unit. The washer 76 has a slot through which the end tongue 74 of the bracket slides.

The opposite end of the respective spring 70 is held with a similar bracket shown at 78 which is bolted onto the lower frame member 40 with a plurality of bolts indicated at 84. The bracket 78 has a tongue 80 that extends through a washer 76 that supports an opposite end of the respective spring 70. The compression springs 70 are heavy compression springs that will at least partially support the weight of broom 47, the broom drive motor 92, as well as the shroud, side plates, and other components that are carried by the bracket assembly 12. The broom drive motor 92 is shown only schematically, but mounts in any desired manner.

The counterbalance force from the springs 70 will be sufficient to provide some "float" or relieving the load on the bristles of the broom 47. Changing the position of the tilt cylinder 22 to change the angle of the loader attachment plate 16 and thus the frame plate 14 will also control downward load. The spring 70 provides some float to relieve pressure on the bristles of brush or broom 47, as the frame assembly 33 pivots. By tilting the upper portion of the adapter plate down, the load on the bristles of the broom 47 will be increased for heavy brushing or brooming, and by tilting the unit backwardly, the load can be decreased and carried primarily by the springs 70 to provide a light sweeping load on the broom bristles to increase broom life when used with dust and small rocks.

It can be seen that suitable lift jack cranks 94 can be provided where desired and used when the broom is to be stored, to support it in a position where it can be attached to a skid steer loader attachment plate quite easily.

The present invention avoids the use of large, long tension springs on the top of the support frame and broom housing, that are long and hinder the operator's view, and also when used with skid steer loaders top mounted springs make access and egress to the loader very difficult.

Adjustments for bristle wear and for down pressure can be carried out by the operator by tilting the attachment plate which will change the relative position of brackets 72 and 78 without dismounting from the loader cab changing the angle of the frame plate 14 results in a greater or less part of the weight of the brush can be supported by the springs 70. The compression springs will provide adequate counterbalance force.

Although the present invention has been described with reference to preferred embodiments, workers skilled in the art will recognize that changes may be made in form and detail without departing from the spirit and scope of the invention.

What is claimed is:

1. A rotary broom mounting comprising:

a rotary implement for engaging the surface of the ground and mountable onto a prime mover;

a mounting frame for connecting the rotary implement to the prime mover comprising:

base frame;

a bracket pivotally mounted to the base frame about a generally horizontal axis; and a lower portion of the bracket moving toward and away from the base frame when the bracket pivots; and at least one compression spring mounted between said base frame and said bracket below the pivot and the bracket, for providing a counterbalance force to the weight of the bracket and the rotary implement resisting pivoting of the bracket toward the base frame and being arranged to exert an upward vertical force component on the bracket when the rotary implement is in contact with the surface for controlling vertical positioning of the rotary implement.

2. The rotary broom mounting of claim 1, wherein said base frame comprises a plate having means for attachment to a skid steer loader, a first separate bracket extending from the plate for each spring and having a tongue positioned inside the spring, and a washer mounted on said tongue for supporting an end of the respective spring.

3. The rotary broom mounting of claim 1, wherein the bracket includes a second separate bracket extending from the lower portion for each spring and having a tongue positioned inside the spring, and a washer mounted on said tongue for supporting an end of the respective spring.

4. In a skid steer loader having loader arms pivotally mounting an adapter plate for attachments, a tilt cylinder for tilting said adapter plate, the improvement comprising a rotary implement mounting including a base frame having means for mounting the base frame on the adapter plate, a bracket assembly including a base section pivotally mounted to the base frame about a generally horizontal axis adjacent an upper side of the base section, a rotary implement mounted on the bracket assembly, the bracket assembly having a lower side, and compression springs between the base frame and the lower side to resist loads, the rotary implement supported on the bracket assembly tending to pivot the base section downwardly to thereby cause the lower side to tend to move toward the base frame.

5. The apparatus of claim 4, wherein said bracket assembly includes an outer section pivotally mounted to the base section about a generally upright axis, and a fluid cylinder between the base section and outer section to control pivoting of the rotary implement about the upright axis.

6. The apparatus of claim 5, wherein said rotary implement comprises a rotary broom attached to the outer section.

7. The apparatus of claim 4, wherein there are two springs mounted between the base frame and the base section of the bracket assembly, the two springs being laterally spaced apart.

8. In a skid steer loader having loader arms pivotally mounting an adapter plate for attachments, a tilt cylinder for tilting said adapter plate, the improvement comprising a rotary implement mounting including a base frame, a releasable coupler for attaching the base frame to the adapter plate, a bracket assembly including a base section pivotally mounted to the base frame about a generally horizontal axis spaced upwardly from a lower portion of the base section, the bracket assembly extending forwardly from the base section, a rotary implement mounted on a forwardly extending portion of the bracket assembly, and at least one compression spring mounted below the horizontal axis and extending between the base frame and the lower portion of the base section of the bracket assembly, the rotary implement supported on the bracket assembly tending to pivot the forwardly extending portion of the bracket assembly downwardly to thereby cause the lower portion of the base section to tend to move toward the base frame, the at least one compression spring resisting movement of the forwardly extending portion downwardly.

* * * * *